United States Patent [19]

Sammon

[11] Patent Number: 5,077,770

[45] Date of Patent: Dec. 31, 1991

[54] HIGH VOLTAGE CAPACITANCE DISCHARGE SYSTEM FOR X-RAY TUBE CONTROL CIRCUITS

[75] Inventor: Robert J. Sammon, Seven Hills, Ohio

[73] Assignee: Picker International, Inc., Highland Heights, Ohio

[21] Appl. No.: 549,402

[22] Filed: Jul. 5, 1990

[51] Int. Cl.[5] ..... H05G 1/10

[52] U.S. Cl. ..... 378/101; 378/103; 315/161; 315/111.01; 315/156

[58] Field of Search ..... 363/59; 315/161, 164, 315/111.01, 86, 156; 378/101, 114, 103

[56] References Cited

U.S. PATENT DOCUMENTS

| | | | |
|---|---|---|---|
| 2,214,441 | 9/1940 | Seaman et al. | 315/164 |
| 3,243,650 | 3/1966 | Hawkins et al. | 315/161 |
| 3,393,338 | 7/1968 | Lee et al. | 315/161 |
| 3,611,433 | 10/1971 | Erst et al. | 315/161 |
| 4,550,272 | 10/1985 | Kimura et al. | 315/86 |
| 4,730,352 | 3/1988 | Rovacchi | 378/101 |

*Primary Examiner*—Edward P. Westin
*Assistant Examiner*—Kim-Kwok Chu
*Attorney, Agent, or Firm*—Fay, Sharpe, Beall, Fagan, Minnich & McKee

[57] ABSTRACT

An exposure control (A) selectively applies electrical power across a transformer (10) of a high voltage power supply (B). The high voltage power supply boosts the voltage such that an output voltage on the order of 150 kV is provided on output lines (20+, 20−). The output lines, typically long cables, are connected with a high voltage device such as an x-ray tube (C) to control the generation of a beam of x-rays (D). Due to high internal capacitance (22, 28) of the power supply, the cables, and the x-ray tube, the output lines continue to carry a potential (34) after the end $t_2$ of the selected duration. At the end of the selected duration, a pulser (62, 80) applies an electrical energy pulse which causes a medium in a gap (56, 76) between electrodes (52, 54; 72, 74) to be ionized. Once the medium is ionized, the stored electrical energy arcs through the ionized medium and flows quickly to ground as indicated at (42).

11 Claims, 3 Drawing Sheets

HIGH VOLTAGE CAPACITANCE DISCHARGE SYSTEM FOR X-RAY TUBE CONTROL CIRCUITS

BACKGROUND OF THE INVENTION

The present invention relates to the art of high voltage control circuits. It finds particular application in conjunction with x-ray tube control circuits and will be described with particular reference thereto.

In x-ray diagnostic equipment, an x-ray tube is commonly turned on or pulsed for a selected duration. More specifically, power is selectively supplied to a high voltage transformer for the selectable duration. High voltage on the secondary side of the transformer is rectified, filtered with a capacitance, and applied across the x-ray tube.

At the end of the actuation period when the supply of electrical potential to the high voltage transformer is terminated, there is still a large amount of electrical energy stored in the capacitance components of the power supply. This energy maintains a potential across the x-ray tube which decays generally exponentially. During this exponential decay period, the x-ray tube produces a generally corresponding decaying amount of x-ray energy. The higher energy portion of the supplied x-rays penetrate the patient and overexpose the photographic film or are detected by electronic x-ray detection circuitry. The lower energy x-rays are absorbed by the patient. Thus, much of the x-ray energy produced after the supply of power to the high voltage transformer has been terminated puts x-rays into the patient with no or detrimental diagnostic value.

In pulsed fluoroscopy experiments, the x-ray tube is pulsed at 0.5 to 5 millisecond intervals to generate relatively low energy x-rays. The stored electrical energy in the system takes a long time, relative to the 0.5 to 5 millisecond pulse intervals to be dissipated. The low energy x-rays from dissipating the capacitors mimics the pulsed low energy pulses and interferes with the diagnostic value of the resultant images.

One prior technique for eliminating the continuing supply of x-ray energy after the selected pulse is terminated is to manufacture the x-ray tube with a grid. By applying appropriate biasing pulses to the grid, the production of x-rays can be sharply turned on and off at the tube. However, such grid-type x-ray tubes require a third control line for which no provision is made in existing equipment. In addition to the incompatibility with existing equipment, grid-type x-ray tubes are limited to operate at lower kV potentials than non-grid tubes.

Another prior art technique is to incorporate a vacuum tube switch in the power supply. At the end of the selected x-ray pulse duration, the vacuum tube is switched conductive providing a low impedance path to discharge the high voltage energy stored in the circuittto ground. However, because x-ray operating voltages are typically on the order of 150 kilovolts, the vacuum tube switch must be physically large. Moreover, such a large vacuum tube generates a large amount of heat for which cooling systems must be provided. Typically, the addition of the vacuum tube and increased cooling capacity approximately doubles the physical size of the power supply circuit. Such a large increase in the size of the power supply renders it unsuitable for use in existing x-ray equipment and increases the complexity of newly designed equipment.

Another solution was to connect a solid state switch, particularly a high voltage triac, between the high potential mains and ground. However, the operating voltage of an x-ray tube exceeds the maximum operating voltage of even high voltage triacs by a large amount. A large array of high voltage triacs, on the order of 100 high voltage triacs, must be ganged together in order to operate at these high potentials, increasing cost and complexity and decreasing reliability. Moreover, an array of 100 high voltage triacs and associated support and biasing circuitry again have a physical size which approximates the physical size of a conventional x-ray tube power supply. Thus, even using solid state switching devices does not significantly decrease the size of the power supply relative to a power supply with a high voltage pentode or other vacuum tube.

The present invention provides a new and improved discharge system which can be added to existing power supplies with a minimal or no increase in their physical size.

SUMMARY OF THE INVENTION

In accordance with one aspect of the present invention, at least one path is provided for draining stored electrical energy in a high voltage power supply to ground. The path passes through an ionizable substance which is substantially non-conducting until ionized. An ionizing means is provided for selectively ionizing the ionizable substance rendering it conductive.

In accordance with a more limited aspect of the invention, the ionizable substance is incorporated in a spark gap device in which the ionizable substance becomes ionized at a preselected ionizing potential, which preselected ionizing potential is selected to exceed the operating potential of an x-ray tube powered by the power supply. The ionizing means includes a means for selectively increasing the potential across the spark gap device from the x-ray tube operating potential to its ionizing potential.

In accordance with another more limited aspect of the present invention, a flash tube type device, e.g. a xenon flash tube, is provided in the path for conveying the stored potential to ground. The ionizing means includes means for applying a trigger voltage to ionize at least a portion of the gas in the tube starting conduction.

One advantage of the present invention is that it rapidly dissipates stored electrical energy.

Another advantage of the present invention is that it self-extinguishing. That is, once conduction starts, the conducted electricity holds it ionized and conductive, when conduction stops, the substance becomes de-ionized and ion-conductive with no outside control.

Another advantage of the present invention is that it reduces patient radiation dose.

Another advantage of the present invention resides in the minimal power supply volume and cost. Control circuitry is simplified. This reduced control simplicity also results in greater reliability.

Still further advantages of the present invention will be apparent to those of ordinary skill in the art upon reading and understanding the following detailed description.

BRIEF DESCRIPTION OF THE DRAWINGS

The invention may embodied in various parts and combinations of parts and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
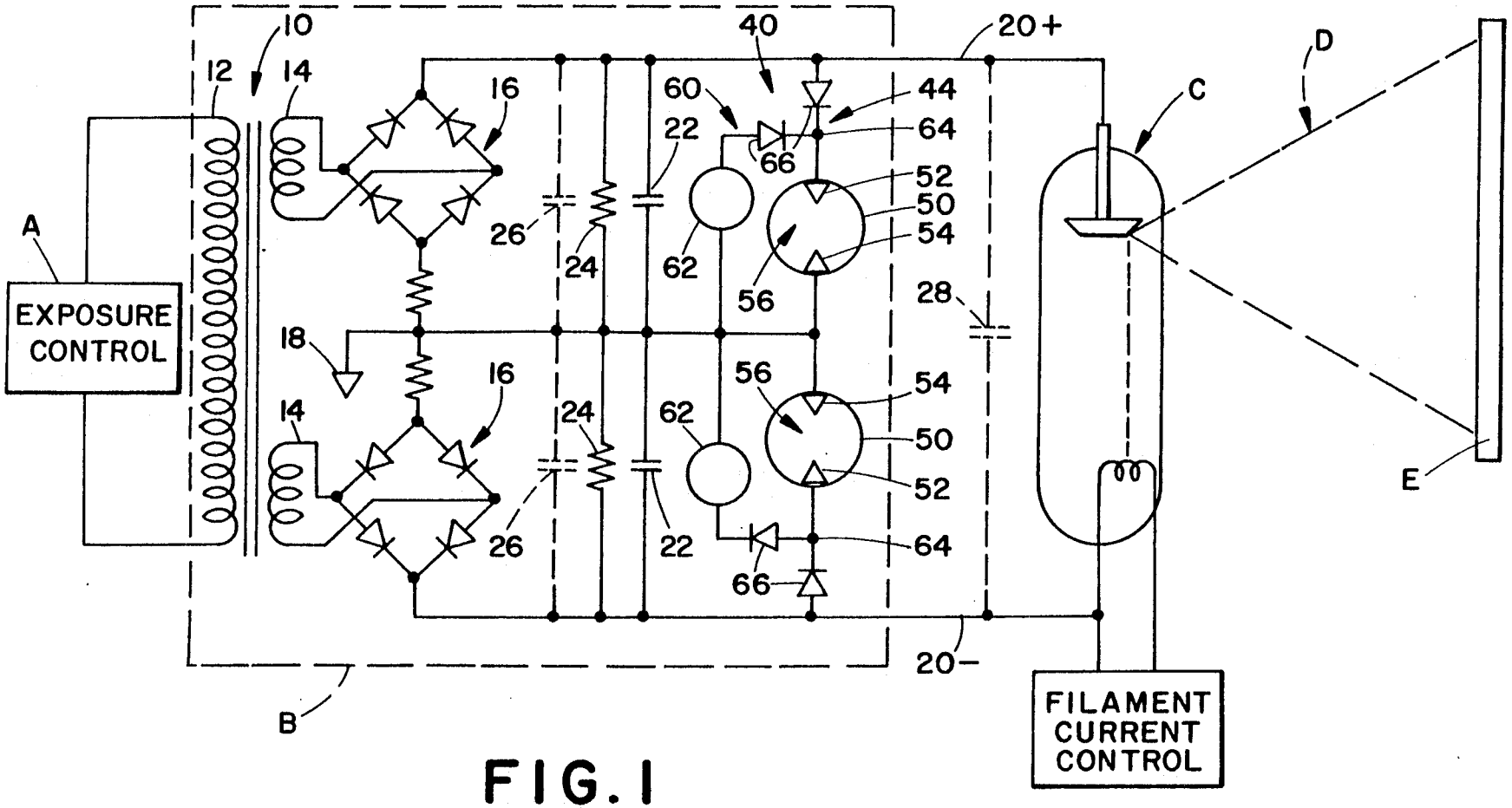
FIG. 1 is a diagrammatic illustration of an x-ray tube and power supply in accordance with the present invention.

With reference to FIG. 1, an x-ray exposure control means A selectively interconnects a power supply B with an external source of power. The power supply B is connected with an x-ray tube 0 such that a high voltage is supplied by the power supply thereacross in order to generate x-rays D. The x-rays pass through a patient receiving region and impinge upon an x-ray sensitive device E, such as photographic film, x-ray excited phosphors, solid state devices for converting x-rays into electrical signals, and the like.

The power supply B includes a high voltage transformer 10. The exposure control means A connects primary windings 12 of the high voltage transformer with a remote power supply for a selectable duration. Secondary coils 14 of the high voltage transformer are each connected with a corresponding rectifier bridge 16. The rectifier bridges are connected between a common ground 18 and one of a high positive voltage line 20+ and a high negative voltage line 20−. Typically, the high voltage transformer is configured such that the high voltage lines are on the order of ±75 kV relative to ground, respectively. In this manner, the potential across the high voltage lines is on the order of 150 kV.

Capacitors 22 may be added between the high voltage lines and ground to smooth the high voltage output. Resistor 24 is connected between the high voltage lines and ground to enable the high voltages to be monitored, to discharge the capacitance, and the like.

In addition to the capacitance 22, the power supply system and particularly the high tension cables connecting the power supply with the x-ray tube have a high internal capacitance denoted schematically at 26. Moreover, the x-ray tube itself has some internal capacitance 28.

Figure 2:
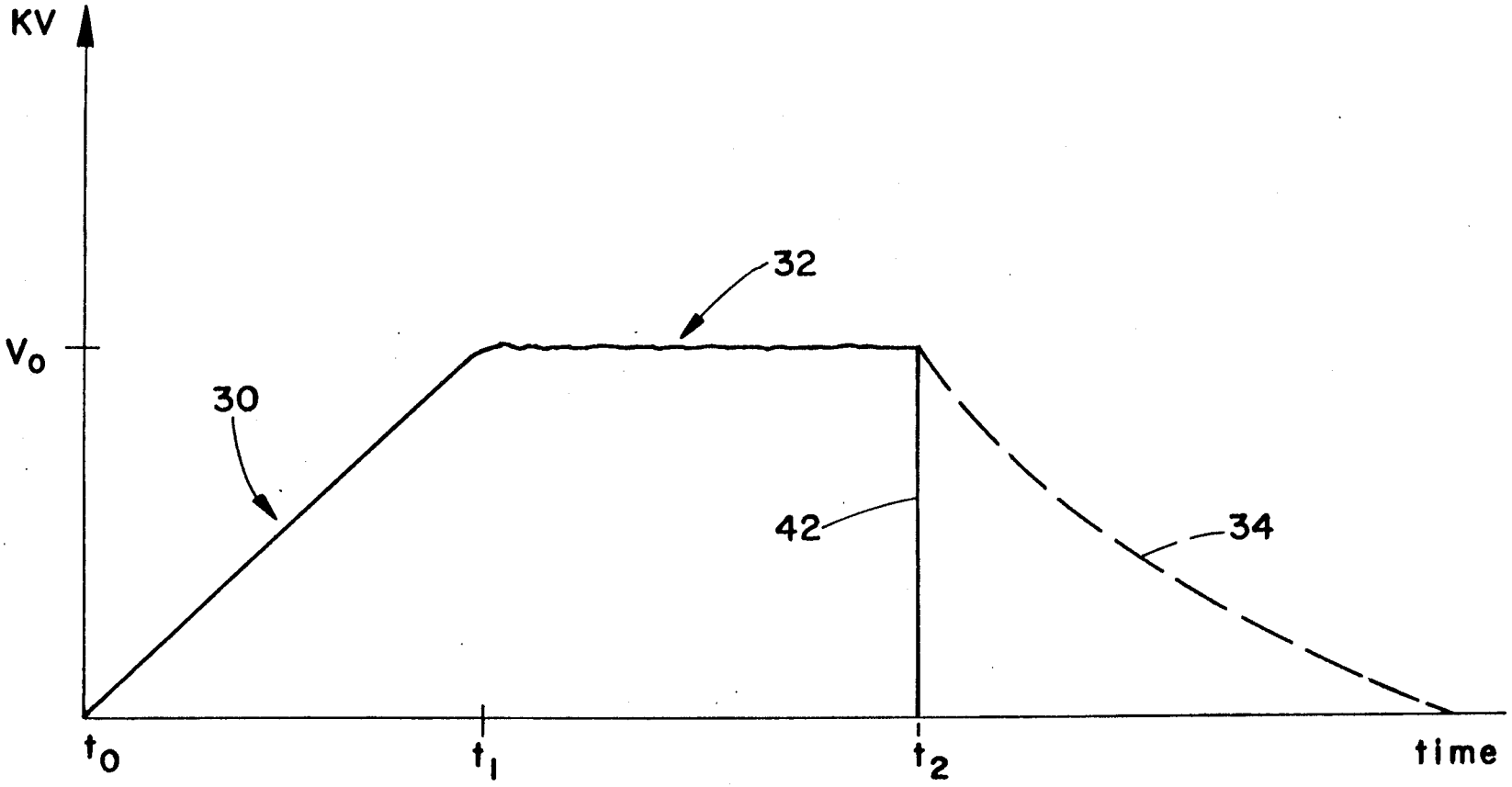
FIG. 2 illustrates the power dissipation rate of the circuit as compared to the prior art shown in phantom.

With reference to FIG. 2, when the exposure control A interconnects the primary coil 12 with a source of external power at time $t_o$, the output across high voltage lines 20+, 20− increases generally linearly 30 until it reaches a selected operating voltage $V_0$ at a time $t_1$. The voltage continues to be supplied at the $V_0$ level 32 until the exposure control A disconnects the primary winding 12 and the external power supply at a time $t_2$. The electrical energy stored in the internal capacitance of the system 22, 28 continues to supply a generally exponentially decaying voltage 34 across the x-ray tube c. The energy of x-rays generated by the tube varies generally with the operating voltage applied across it.

With continuing reference to FIG. 2 and further reference to FIG. 1, a means 40 is provided in the power supply for abruptly dropping the output voltage to zero at time $t_2$ as illustrated along curve segment 42. Specifically, the means 40 includes plasma devices 44 for controllably and selectively arcing the high positive and negative voltage lines 20+, 20− to ground. In the embodiment of FIG. 1, the plasma devices are spark gap devices 50 that each include a pair of electrodes 52, 54 with an ionizable material in a gap 56 therebetween. The ionizable material in the gap, such as air, is effectively non-conductive until it is ionized. Once ionized, the material becomes highly conductive and remains conductive until substantially all the electrical energy is discharged. Thereafter, the material loses its ionization and becomes effectively non-conductive.

In a spark gap device, the potential at which the material in the gap becomes conductive is set by the spacing between the electrodes 52, 54 and the nature of the material in the gap. The larger gap, the higher the ionization potential. For example, when using air as the ionizable material, a gap of about one foot has an ionization potential of about 200 kV. For other materials, such as oil, the gap is significantly shorter. Other gases, liquids, and solids may also be utilized.

The gap between the electrodes is selected relative to the material in the gap such that it has a selected ionization potential that is higher than a normal output operating potential of the high voltage lines 20+, 20− by an amount in excess of normal fluctuations of the voltages on these lines, e.g. 10%. Thus, for voltage supply that provides +75 kV on lines 20+ and −75 kV on line 20−, spark gap devices with ionization potentials of about 150–200 kV are selected.

An ionizing means 60 selectively ionizes the material in the gap. In the embodiment of FIG. 1, the ionizing means includes a pair of control voltage pulse means or devices 62 which when activated supply a voltage pulse. The pulse is additively combined at summing functions 64 with the potential from a selected one of output lines 20 and are applied across the spark gap device. The output voltage of the pulse means is selected such that the sum of the voltage pulse and the voltage on the high tension output lines meet or exceed the ionization potential. This causes the material in the gap to be ionized and the stored potential in the system to arced rapidly to ground bringing the voltage across the x-ray tube c rapidly to zero as illustrated by curve segment 42. Diodes 66 isolate the control voltage pulse from the output lines 20 such that the summed voltage pulse is applied only across the spark gap devices.

Figure 3:
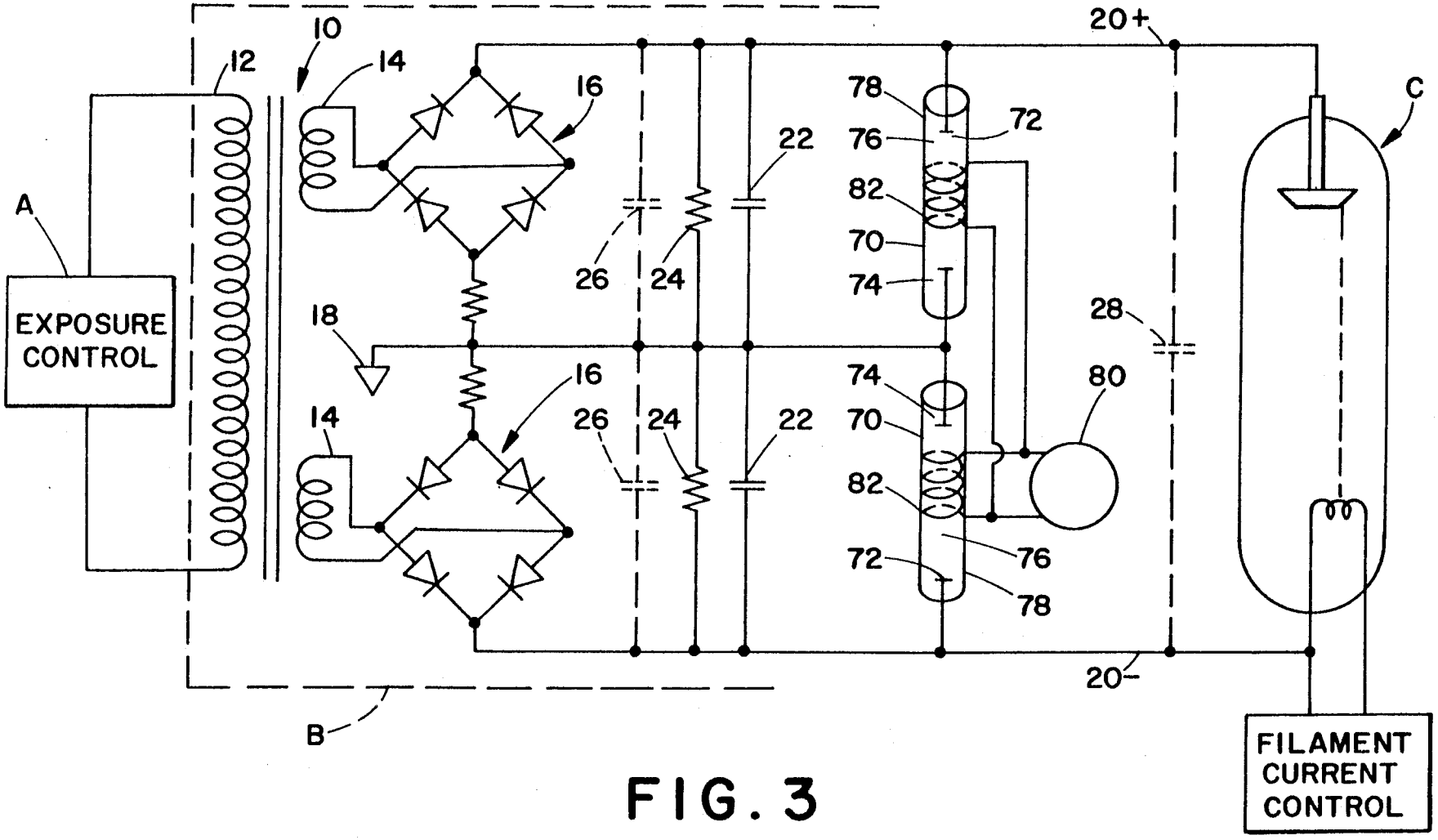
FIG. 3 is an alternative embodiment of the power supply of FIG. 1.

In the embodiment of FIG. 3, the plasma devices include a pair of flash tubes 70. Each flash tube is a pair of electrodes 72, 74 between which a gap 76 is defined. An outer enclosure 72 confines a selected gas, such as xenon or other inert or less readily ionizable gases in the gap 76. The ionizing means 60 includes a control circuit means to for selectively applying an appropriate potential to leads 82 to ionize at least a portion of the gas within the associated flash tube. The flash tubes are again selected to have an ionizing potential which is higher than the operating potential of the x-ray tube until the gas is fully or partially ionized by the potential applied to leads 82. The ionization potential of the flash tubes is again determined by the length of the gap between the electrodes and the nature of the material between the electrodes.

With both the flash tube and spark devices, a plurality of the devices can be placed in series to raise the effective ionization potential of the combination.

The invention has been described with reference to the preferred embodiment. Obviously, modifications and alterations will occur to others upon reading and understanding the preceding detailed description. It is intended that the invention be construed as including all such alterations and modifications insofar as they come within the scope of the appended claims or the equivalents thereof.

Having thus described the preferred embodiment, the invention is now claimed to be:

1. In an x-ray tube power supply circuit for supplying an operating voltage to an x-ray tube for a selected duration, which power supply circuit has (i) a transformer that receives an input voltage for a selected duration and produces an output voltage from a secondary winding for the selected duration and (ii) an array of electrical elements connected by electrical conductors between the secondary winding and the x-ray tube for rectifying the output voltage and supplying an output potential to the x-ray tube for the selected duration, but which array of elements, secondary winding, and electrical conductors have a high capacitance which stores a potential derived from the output voltage during the selected duration and continues to supply the stored potential to the x-ray tube after the selected duration and after the transformer has stopped receiving the input voltage, the improvement comprising:

a means connected between the secondary winding and the x-ray tube for controllably discharging the potential stored in the capacitance of the array of elements, secondary winding, and electrical conductors to ground through an ionized medium at the end of the selected duration.

2. The power supply circuit as set forth in claim 1 wherein the discharging means includes:

an ionizable medium disposed between the electrodes; and, a controlled means for ionizing the ionizable medium at the end of the selected duration in order to render the ionizable medium conductive such that the electrical energy from the capacitance discharges under control at the end of the selected duration through the ionized medium between the electrodes.

3. The power supply circuit as set forth in claim 2 wherein the gap between the electrodes and the ionizable medium are selected such that the ionizable medium requires a potential in excess of an operating voltage of the x-ray tube in order to become ionized and wherein the means for ionizing the medium includes a voltage pulse source for selectively supplying a voltage pulse which is summed with the operating potential which voltage sum is applied across the electrodes, the voltage pulse supplied by the voltage pulse means being of a sufficient magnitude that the voltage sum causes the ionizable medium to ionize, becoming conductive and remaining ionized and conductive until the energy stored in the capacitance of the array of elements is dissipated to ground.

4. The apparatus as set forth in claim 3 wherein the electrodes and the ionizable medium are contained in a spark gap device.

5. The power supply circuit as set forth in claim 3 wherein the gap between the electrodes and the ionizable medium are selected such that the medium remains non-ionized at the operating voltage of the x-ray tube and wherein the ionizing means includes means for generating a trigger pulse which ionizes a sufficient fraction of the ionizable medium that at the x-ray tube operating voltage the remainder of the medium becomes ionized and conductive and remains ionized and conductive until the potential energy stored in the internal capacitance is discharged to ground.

6. An x-ray diagnostic apparatus comprising:

an x-ray tube which projects a beam of x-rays through a patient examination region to an x-ray sensitive medium when a selected x-ray tube operating voltage is applied thereacross;

a power supply having first and second output lines operatively connected with the x-ray tube for providing the preselected operating voltage across the x-ray tube;

a first plasma device connected between the power supply first output line and ground, the first plasma device including an ionizable medium disposed in a gap between electrodes, one of the electrodes being operatively connected with the first power supply output line, the medium in the gap having an ionization potential such that the medium remains non-ionized when the first output line is carrying the x-ray tube operating voltage;

an x-ray exposure control means for selectively causing the power supply to supply the x-ray tube operating voltage across the first and second output lines from a first time to a second time; and a first ionizing means controlled by the exposure control means for ionizing the first plasma device ionizable medium at the second time.

7. The apparatus as set forth in claim 6 wherein:

a second plasma device is operatively connected between the power supply second output line and ground, the second plasma device including an ionizable medium disposed in a gap between electrodes, one of the electrodes being operatively connected with the ground and another electrode being operatively connected with the power supply second output line, the medium in the gap having an ionization potential such that the medium remains non-ionized when the second output line is carrying the x-ray tube operating voltage;

a second ionizing means for ionizing the second plasma device ionizable medium under control of the exposure control means at the second time.

8. The power supply circuit as set forth in claim 7 wherein the gap between the electrodes and the ionizable media are selected such that the ionizable media remains at a non-ionized potential at the operating voltage and ionizes at an ionization voltage in excess of an operating voltage of the x-ray tube and wherein the first and second ionizing means include a voltage pulse source for selectively supplying a voltage pulse which is summed with the operating potential and the voltage sum applied across the electrodes, the voltage pulse supplied by the voltage pulse means being of a sufficient magnitude that the voltage sum exceeds the ionizing voltage and causes the ionizable media to ionize, becoming conductive and remaining ionized and conductive until the energy stored in power supply internal capacitance is dissipated to ground.

9. The power supply circuit as set forth in claim 7 wherein the gap between the electrodes and the ionizable media are selected such that the media remains non-ionized when the operating voltage of the x-ray tube is applied across the first and second output lines and wherein the ionizing means includes means for generating a trigger pulse which ionizes a sufficient fraction of the ionizable media that the x-ray tube operating voltage applied across the first and second output lines causes the remainder of the media to ionize becoming conductive and remaining ionized and conductive until the potential energy stored in the internal capacitance is discharged to ground.

10. A high voltage power supply for x-ray tubes, the power supply comprising:

a transformer for boosting an input voltage to a selected high voltage, the transformer being operatively connected to output lines for carrying the high voltage to an x-ray tube;

a capacitance means which stores an electrical potential and continues to supply the stored potential to the output lines after the transformer stops receiving the input voltage, whereby the x-ray tube continues to receive an operating voltage after receipt of input voltage stops;

a plasma means connected with the output lines, the plasma means including an ionizable medium disposed between a pair of electrodes that are operatively connected with the output lines, the ionizable medium having an ionization potential such that the medium remains non-ionized when the output lines are carrying the selected high voltage;

an ionizing means for controllably ionizing the ionizable medium such that the electrical potential sorted in the capacitance means is discharged rapidly through the ionized medium on controlled command when the transformer stops receiving the input voltage, whereby the electrical potential sorted in the capacitance means is discharged through the ionized medium instead of providing a lingering voltage on the output lines to the x-ray tubes.

11. A method for applying high voltage pulses to an x-ray tube for a selected duration, the method comprising:

boosting an input voltage to the selected high voltage and (i) supplying the high voltage to the x-ray tube to cause the generation of x-rays thereby and concurrently (ii) capacitively storing a portion of the electrical energy;

at the end of the selected duration, discharging the capacitively stored electrical energy through a controllably ionized plasma to ground, whereby the capacitively stored electrical energy is rapidly discharged without continuing to supply the high voltage to the x-ray tube to cause continued generation of x-rays after the selected duration.

* * * * *